US005727445A

United States Patent [19]

Sheldon

[11] Patent Number: 5,727,445

[45] Date of Patent: Mar. 17, 1998

[54] ACTUATOR CYLINDER WITH MECHANISM TO REDUCE STICTION

[75] Inventor: Paul C. Sheldon, Mequon, Wis.

[73] Assignee: Sheldon/Van Someren, Inc., Wauwatosa, Wis.

[21] Appl. No.: 746,081

[22] Filed: Nov. 6, 1996

[51] Int. Cl.[6] ..... F01B 21/00

[52] U.S. Cl. ..... 92/2; 92/31; 92/168

[58] Field of Search ..... 92/31, 32, 2, 33, 92/168

[56] References Cited

U.S. PATENT DOCUMENTS

| | | | |
|---|---|---|---|
| 280,668 | 7/1883 | Rawlins | 92/2 |
| 3,508,472 | 4/1970 | Hartwick, Jr. | 92/31 |
| 3,815,479 | 6/1974 | Thompson | 92/2 |
| 3,953,967 | 5/1976 | Smith | 60/39.28 |
| 3,973,468 | 8/1976 | Russell, Jr. | 92/2 |
| 4,663,938 | 5/1987 | Colgate | 91/50 |
| 5,099,749 | 3/1992 | Darish | 92/2 |
| 5,381,723 | 1/1995 | Nilsson et al. . | |
| 5,423,727 | 6/1995 | Fellows | 476/40 |
| 5,456,160 | 10/1995 | Caldwell . | |
| 5,467,689 | 11/1995 | Carlin et al. . | |

*Primary Examiner*—Thomas E. Denion

[57] ABSTRACT

A linear actuator cylinder reduces the stiction otherwise present during initiation of rod extension or retraction. The actuator cylinder includes a cylinder assembly having a piston that slides longitudinally through a cylinder barrel. A rod is connected to the piston and extends from the cylinder barrel. A rotator mechanism is connected to the rod to rotate the piston and rod with respect to the cylinder barrel. The rotator mechanism typically includes a hydraulic or electric motor connected to the rod by, for example, a chain engaged with a pair of sprockets.

20 Claims, 2 Drawing Sheets

ACTUATOR CYLINDER WITH MECHANISM TO REDUCE STICTION

FIELD OF THE INVENTION

The present invention relates generally to actuator cylinders, such as hydraulic or pneumatic cylinders, and particularly to actuator cylinders designed to eliminate stiction during initiation of extension or retraction of the cylinder.

BACKGROUND OF THE INVENTION

Actuator cylinders, such as hydraulic and pneumatic cylinders, are used in numerous environments to induce movement of one object with respect another. Typically, the actuator cylinder includes a cylinder barrel capped by a pair of ends. A piston and rod assembly are disposed within the cylindrical barrel for longitudinal movement. The rod extends through an opening in one of the ends and usually has some type of attachment mechanism by which it is attached to a machine component. The other end, i.e. the cylinder end, also has an attachment mechanism by which it is attached to a second machine component. Seals are disposed between the piston and the interior wall of the cylinder barrel as well as between the rod and the interior surface of the opening through which it extends. By introducing fluid, such as air or hydraulic fluid, into the hollow interior on one side of the piston or the other, the piston is driven longitudinally along the cylinder barrel. Thus, the two attachment devices, and attached components, may be moved towards or away from one another.

Typically, the seals around the piston slide against the interior wall of the cylinder barrel, and the seals around the rod are slidably engaged with the rod. Due to this sliding contact, a greater force is required to initiate movement of the piston from an "at rest" position than the force necessary to maintain movement. This greater force is often referred to as stiction.

Stiction causes severe problems in controlling the motion of the actuator cylinder, particularly when used in an environment that requires frequent changes from the static state to the dynamic state, i.e. frequent stopping and starting of piston movement. The extra force required to initiate movement of the piston and rod assembly relative to the cylinder barrel causes undesirable stick-slip that results in unwanted accelerations. For example, undesirable piston movement is a frequent problem in servo controlled devices, due to the difficulty of accurately controlling the application of non-linear forces to counteract the effects of stiction. In many of applications, it is desirable to reduce or eliminate these unwanted accelerations and provide consistently smooth actuation of the cylinder.

It would be advantageous to have a mechanism for reducing or eliminating stiction.

SUMMARY OF THE INVENTION

The present invention relates to an actuator cylinder designed to reduce stiction. According to one embodiment of the invention, the actuator cylinder includes a cylinder barrel having a hollow interior. A first end and a second end are attached to the cylinder barrel on opposite sides. A piston is slideably mounted in the hollow interior, and a rod is connected to the piston. The rod extends from the piston through an opening in the second end, such that it may slide back and forth through this opening as the piston reciprocates within the cylinder barrel. A rotator mechanism is connected to the cylinder assembly to impart relative rotation between the piston and the cylinder barrel, thereby eliminating the static state.

According to another aspect of the invention, a method is provided for reducing stiction in a linear actuator cylinder of the type having a cylinder barrel in which a piston and rod assembly is slideably mounted. The piston and rod assembly is designed for reciprocating motion along the linear axis of the cylinder barrel. This method comprises the steps of connecting a rotator mechanism to at least one of the cylinder barrel or the piston and rod assembly. The method further includes the step of imparting relative rotational movement between the cylinder barrel and the piston and rod assembly. In one embodiment of the invention, a drive mechanism is mounted to a rod of the piston and rod assembly, while a motor is attached to a fixture rotatably mounted to the rod. Thus, the motor and drive mechanism cooperate to rotate the piston and rod assembly within the cylinder barrel, thereby obviating stiction.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
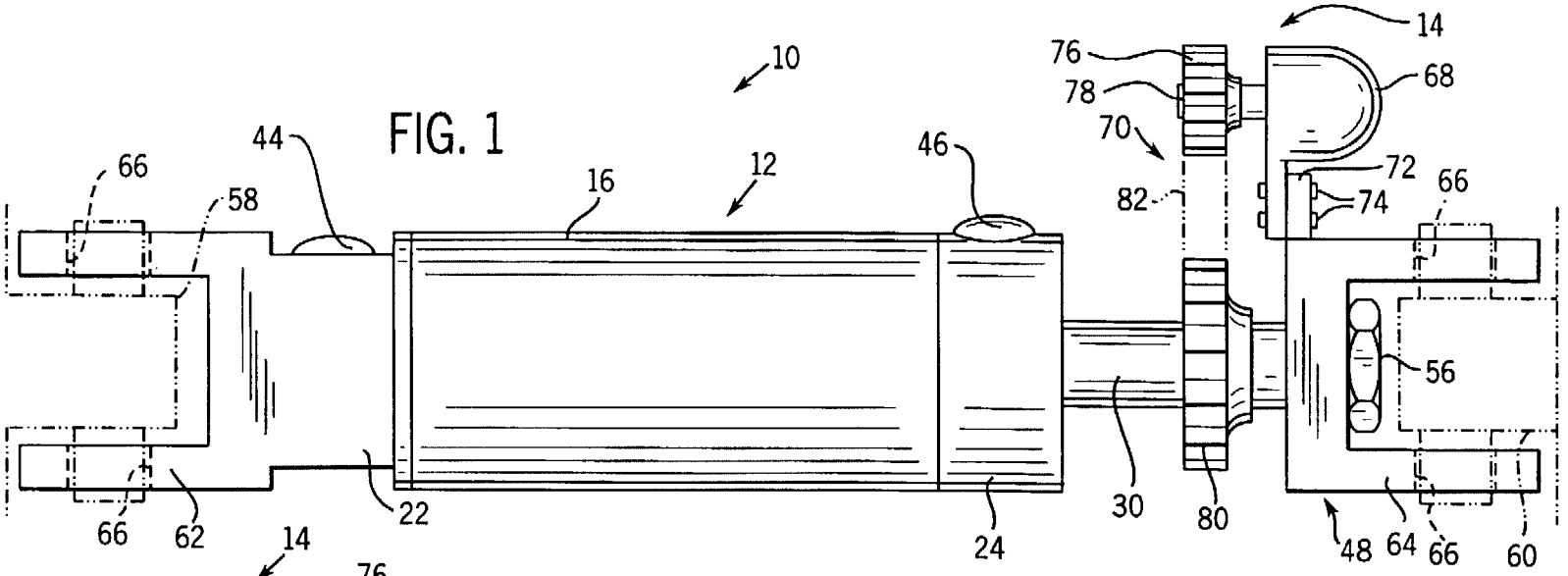
FIG. 1 is a front view of an actuator cylinder according to a preferred embodiment of the present invention.
Figure 2:
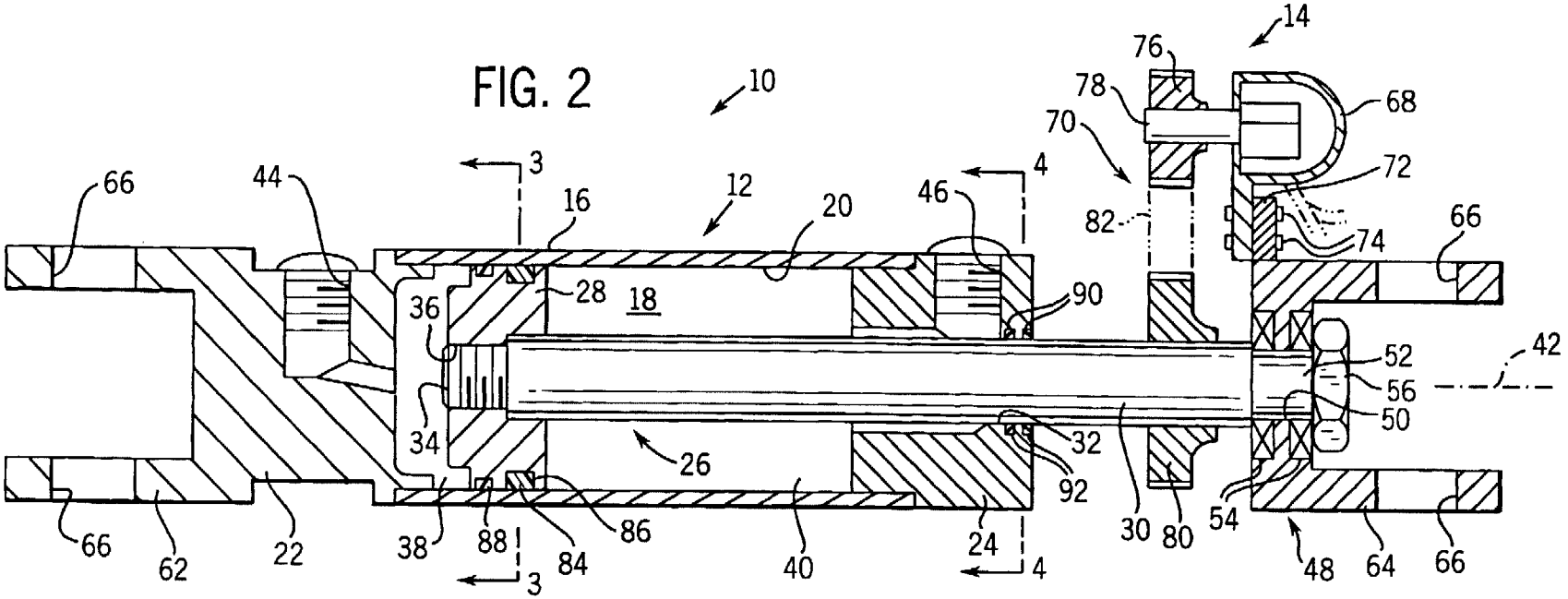
FIG. 2 is a cross sectional view of the actuator cylinder illustrated in FIG. 1.

Referring generally to FIGS. 1 and 2, an actuator cylinder 10 is illustrated, according to a preferred embodiment of the present invention. Actuator cylinder 10 comprises a cylinder assembly 12 connected to a rotator mechanism 14.

Cylinder assembly 12 includes a cylinder barrel 16 having a hollow interior 18 defined by an interior cylindrical surface 20. A first end 22 is attached to one end of cylinder barrel 16, and a second end 24 is attached to an opposite end of cylinder barrel 16 to substantially enclose hollow interior 18. First end 22 and second end 24 may be attached to cylinder barrel in a variety of ways known to those of ordinary skill in the art. For example, they may be threadably engaged, locked in place with a lock ring and seal or held together by four external rods as is known to those of ordinary skill in the art.

A piston and rod assembly 26 is slideably mounted within hollow interior 18. Specifically, piston and rod assembly 26 includes a piston 28 and a rod 30. Rod 30 extends from piston 28 through an opening 32 formed in second end 24, as illustrated best in FIG. 2. Rod 30 may be connected to piston 28 in a variety of ways, but preferably includes a threaded end 34 threadably engaged with an opening 36 in piston 28.

Piston 28 extends radially outward from rod 30 and is designed for sliding movement along interior cylindrical surface 20 of cylinder barrel 16. Thus, piston 28 divides hollow interior 18 into a first compartment 38 disposed between first end 22 and piston 28 and a second compartment 40 disposed between second end 24 and piston 28. By appropriately introducing pressurized fluid, such as air or hydraulic fluid, into one, or in some cases both, first compartment 38 and second compartment 40, the piston 28 and rod 30 can be forced to move longitudinally along an axis 42, as illustrated in FIG. 2.

Fluid may be introduced into and released from first compartment 38 via a fluid port 44 disposed through first end 22. Similarly, fluid may be introduced into and released from second compartment 40 via a fluid port 46 disposed through second end 24. Depending on the application, conventional hydraulic or pneumatic hoses can be connected to fluid ports 44 and 46. When fluid is introduced into first compartment 38 through fluid port 44 and under sufficient pressure to overcome any counteracting forces, piston 28 is driven towards second end 24 and rod 30 extends farther from second end 24. Any fluid in second compartment 40 can escape through fluid port 46. Similarly, when fluid is introduced into second compartment 40 through fluid port 46 and under sufficient pressure to overcome any counteracting forces, piston 28 is driven towards first end 22 and rod 30 is further retracted with respect to second end 24. Any fluid in first compartment 38 can escape through fluid port 44. Thus, the extension and retraction of actuator cylinder 10 is controlled by the selective introduction of pressurized fluid into hollow interior 18.

In the preferred embodiment, a fixture 48 is rotatably attached to rod 30 at, for example, an end opposite piston 28. Fixture 48 may be mounted to rod 30 in a variety of ways, but a preferred way is illustrated in FIG. 2. In this embodiment, fixture 48 includes an opening 50 therethrough for rotatably receiving an end 52 of rod 30. End 52 has a reduced diameter, as illustrated. A bearing and typically a pair of bearings 54 are mounted in opening 50 to permit rod 30 to rotate freely with respect to fixture 48. Bearings 54 should be of the axial load bearing type and may comprise, for example, a pair of tapered roller bearings. Rod 30 is held in place by a retainer 56, such as a nut or clip ring.

Actuator cylinder 10 is designed for connection between a pair of objects, such as first component 58 and second component 60, both illustrated by dashed lines in FIG. 1. For example, an attachment bracket 62 can be connected to or integrally formed with first end 22. A second attachment bracket 64 can be attached to or integrally formed with fixture 48. In the illustrated embodiment, attachment brackets 62 and 64 are clevis style brackets having appropriate openings 66 therethrough to facilitate attachment to first component 58 and second component 60. However, there are many styles of attachment brackets that could be used, depending on the application.

In the preferred embodiment, rotator mechanism 14 includes a motor 68 and a drive system 70. Motor 68 is mounted to fixture 48 by a mounting bracket 72. One or more fasteners 74 can be used to secure motor 68 to bracket 72, as illustrated.

Drive system 70 is coupled between motor 68 and rod 30. Thus, when actuator cylinder 10 is mounted between first component 58 and second component 60, motor 68 rotates rod 30 and piston 28 with respect to both fixture 48 and cylinder barrel 16. It should be noted that if rod 30 is threadably engaged with piston 28, it is preferred that motor 68 rotates rod 30 in a direction that would tend to tighten the threaded engagement. In the preferred embodiment, drive system 70 includes a first sprocket 76 mounted to a shaft 78 of motor 68. A second sprocket 80 is mounted to rod 30, and a chain 82 (shown in dashed lines) is disposed about first sprocket 76 and second sprocket 80. However, drive system 70 may comprise a variety of mechanisms including sprockets, pulleys and direct gear drives.

Preferably, motor 68 is a fluid driven motor, such as a hydraulic motor, but the specific type and torque rating may vary depending on the size of actuator cylinder 10 and the environment in which it is used. For example, motor 68 could be a hydraulic motor of the type described in U.S. Pat. No. 5,381,723 issued on Jan. 17, 1995. Additionally, a variety of suitable hydraulic motors is available from Vickers, Incorporated located in Maumee, Ohio. As an alternative, electric motors could be used in many applications.

In the preferred embodiment, motor 68 and drive system 70 cooperate to rotate rod 30 and piston 28 at a speed from one to ten revolutions per minute, and most preferably at a speed of two to three revolutions per minute. However, the optimal speed will be determined by the characteristics of the seals and the surfaces in sliding contact with the seals. Motor 68 and drive system 70 usually are designed to rotate rod 30 and piston 28 continuously. However, in some applications it may be desirable to control motor 68 such that rod 30 and piston 28 are rotated only during initiation of axial movement of piston 28. The rotation of rod 30 and piston 28 eliminates the static state of piston and rod assembly 26 during initiation of longitudinal movement, and therefore substantially reduces or eliminates the deleterious effects of stiction.

Whenever sliding components are changed from the static state to the dynamic state, stiction is present to some degree. With hydraulic and pneumatic cylinders, stiction typically is caused by seals disposed between piston 28 and cylinder barrel 16 as well as seals disposed between rod 30 and second end 24 proximate opening 32. The seals are arranged to prevent unwanted flow of fluid past piston 28 or out of hollow interior 18. One example is illustrated best in FIG. 2. In this embodiment, an annular seal 84 is disposed within a groove 86 about the circumference of piston 28. Annular seal 84 slides along interior cylindrical surface 20 and substantially seals first compartment 38 from second compartment 40. As understood by those of ordinary skill in the art, many types of seals are available and typically include an elastomeric material often bounded by a pair of washers that facilitate sealing under higher fluid pressures. Although annular seal 84 is illustrated as disposed within a groove on piston 28, the seal also could be attached to cylinder barrel 16 to permit piston 28 to slide therethrough. In this latter embodiment, piston 28 would tend to have a greater length in the axial direction and have a smooth circumference uninterrupted by grooves.

Often, a wear ring 88 is disposed about piston 28. Typically, wear ring 88 does not form a tight seal with interior cylindrical surface 20, and thus does not contribute substantially to the problematic stiction.

At least one seal and preferably a pair of seals 90 are disposed between rod 30 and second end 24 proximate opening 32. In the illustrated embodiment, a pair of seals 90 are received in a pair of annular grooves 92 formed in second end 24 along opening 32, as illustrated best in FIG. 2. Typically, seals 90 also are elastomeric seals. By rotating rod 30 and piston 28 relative to cylinder barrel 16 during initiation of the piston's longitudinal movement, the stiction normally caused by annular seal 84 and seals 90 is substantially reduced if not eliminated.

Figure 4:
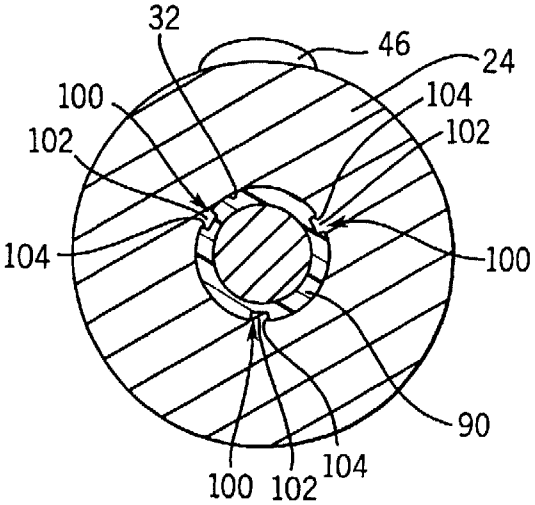
FIG. 4 is a cross sectional view taken generally along line 4—4 of FIG. 2.
Figure 3:
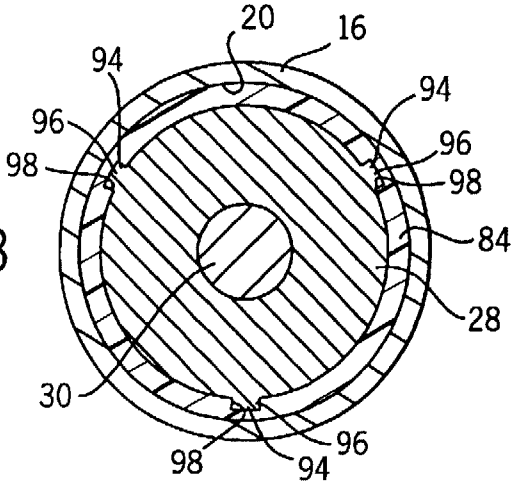
FIG. 3 is a cross sectional view taken generally along line 3—3 of FIG. 2.

As illustrated in FIGS. 3 and 4, an anti-rotation mechanism 94 may be necessary to prevent unwanted rotation of seals 84 and 90. For example, when annular seal 84 is disposed about piston 28 in groove 86, an anti-rotation mechanism 94 prevents rotation of annular seal 84 with respect to piston 28. A preferred embodiment of anti-rotation mechanism 94 includes a plurality of tabs 96 disposed in grove 86. For example, three tabs 96 can be formed to extend from the base of groove 86 to cooperate with corresponding recessed regions 98 formed in the interior surface of annular seal 84. This will ensure that seal 84 rotates with piston 28. If wear ring 88 contacts interior cylindrical surface 20, it may be necessary to provide a similar anti-rotation mechanism to ensure that wear ring 88 also rotates with piston 28.

Similarly, with respect to seals 90, an anti-rotation mechanism 100 is disposed to maintain seals 90 in a fixed position relative to second end 24. For example, a plurality of tabs 102, e.g., three tabs, can be formed to extend inwardly from the base of each groove 92. Tabs 102 are received in corresponding recessed regions 104 formed in the outer surface of each seal 90. Thus, when rod 30 rotates with respect to second end 24, seals 90 remain in a fixed position relative to second end 24.

Figure 5:
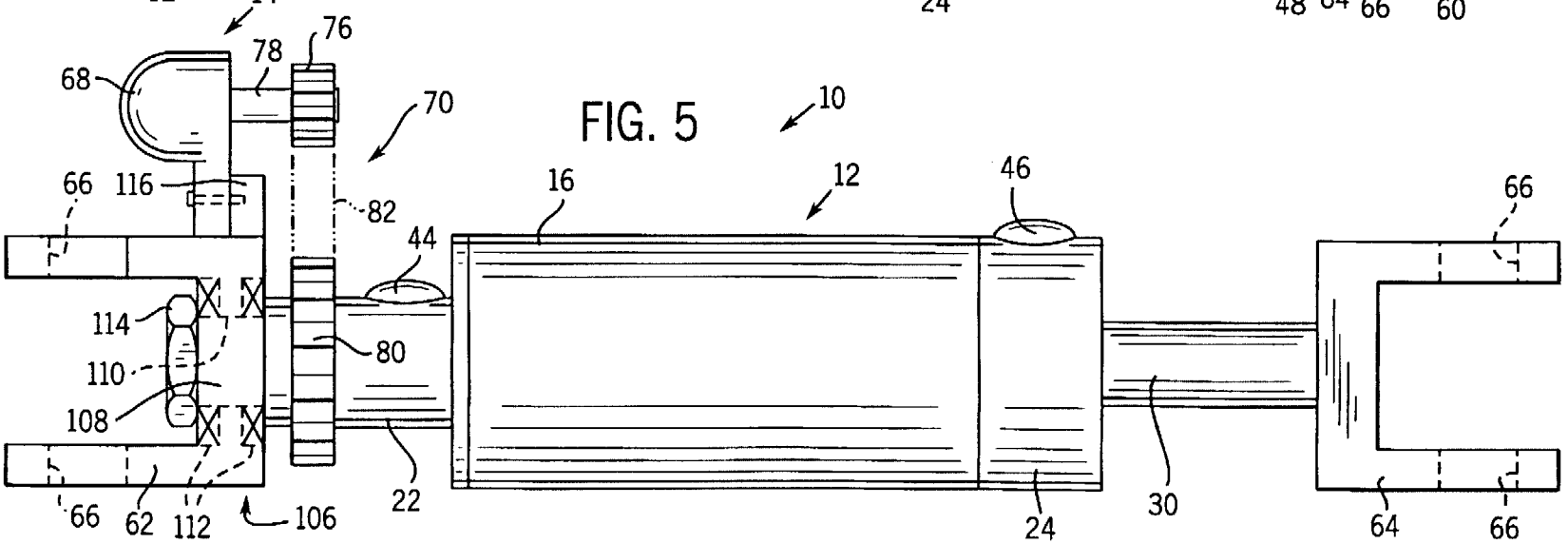
FIG. 5 is a front view of an alternate embodiment of the actuator cylinder.

Other arrangements also could be used to impart relative rotational movement of the cylinder barrel with respect to the piston and rod assembly. For example, in FIG. 5, an alternate embodiment is illustrated in which cylinder barrel 16 is rotated by rotator mechanism 14 to impart relative rotation between cylinder barrel 16 and piston and rod assembly 26. (For clarification, common reference numerals will be used in both FIGS. 5 and FIGS. 1–4 where the components are the same or similar.) In this embodiment, second attachment bracket 64 is affixed to rod 30. A fixture 106 is rotatably mounted to first end 22, and attachment bracket 62 extends from fixture 106.

Specifically, first end 22 includes a section 108 of reduced diameter that is received through an opening 110 formed in fixture 106. As described above, fixture 106 preferably is mounted to section 108 by a bearing or a pair of bearings 112 that are able to support a load. A retainer 114, such as a nut or lock ring, is connected to section 108 to hold fixture 106 in place on first end 22.

As illustrated, motor 68 is mounted to fixture 106 by a mounting bracket 116 and drive system 70 is coupled between motor 68 and first end 22. When first attachment bracket 62 and second attachment bracket 64 are connected to components 58 and 60, motor 68 and drive system 70 can rotate cylinder barrel 16 with respect to piston 28 and rod 30 to reduce or eliminate stiction.

With this arrangement, the continued rotation of cylinder barrel 16 in one direction can potentially wrap or tangle the pneumatic or hydraulic hoses connected to fluid ports 44 and 46. However, this problem could be overcome by alternating the actuation of motor 68 between a forward mode and a reverse mode. In other words, cylinder barrel 16 could be rotated through a predetermined angle in one direction and then reversed and rotated back through that same angle. By selectively or continuously repeating this cycle, the problems associated with stiction can be reduced substantially. In some applications, the hoses could be connected to appropriately designed and located fluid ports by rotary unions to permit continued rotation in one direction.

It will be understood that the foregoing description is of preferred exemplary embodiments of this invention and that the invention is not limited to the specific forms shown. For example, a variety of hydraulic or pneumatic cylinder styles could incorporate the anti-stiction components of the present invention. Additionally, a variety of rotational drive mechanisms and attachment brackets could be used, and numerous types of seals and seal arrangements could be incorporated into the design. These and other modifications may be made in the design and arrangement of the elements without departing from the scope of the invention as expressed in the appended claims.

What is claimed is:

1. An actuator cylinder designed to reduce stiction, comprising:

a cylinder assembly including:

a cylinder barrel having a hollow interior;

a first end and a second end connected to the cylinder barrel, the second end having an opening therethrough and being connected on an opposite side of the hollow interior from the first end;

a piston slidably mounted in the hollow interior; and a rod extending from the piston and slidably received through the opening;

a rotator mechanism connected to the cylinder assembly, wherein the rotator mechanism is able to impart relative rotation between the piston and the cylinder barrel; and an elastomeric seal disposed between the piston and an interior wall of the cylinder barrel, wherein the piston includes an annular groove configured to receive the elastomeric seal and an anti-rotation mechanism that cooperates with the seal to limit movement of the seal along the groove.

2. The actuator cylinder as recited in claim 1, wherein the cylinder assembly further includes a fixture rotatably mounted to the rod opposite the piston.

3. The actuator cylinder as recited in claim 2, wherein the rotator mechanism includes motor mounted to the fixture and a drive system coupled to the motor and to the rod.

4. The actuator cylinder as recited in claim 3, wherein the motor is a fluid driven motor.

5. The actuator cylinder as recited in claim 3, wherein the motor is an electric motor.

6. The actuator cylinder as recited in claim 3, further comprising a first attachment bracket connected to the first end and wherein the fixture includes a second attachment bracket.

7. The actuator cylinder as recited in claim 1, further comprising a fixture rotatably mounted to the first end, wherein the rotator mechanism includes a motor and a drive system, the motor being mounted to the fixture, and the drive system being coupled to both an output shaft of the motor and the first end.

8. The actuator cylinder as recited in claim 7, wherein the motor is a hydraulic motor.

9. The actuator cylinder as recited in claim 1, wherein the motor is an electric motor.

10. The actuator cylinder as recited in claim 1, wherein the anti-rotation mechanism includes at least one tab that interacts with the elastomeric seal to limit its movement along the groove.

11. The actuator cylinder as recited in claim 1, further comprising a second elastomeric seal diposed between the rod and the opening, wherein the opening, includes annular groove configured to recieve the second elastomeric seal and an anti-rotation mechanism that cooperates with the second seal to limit movement of the second seal along the groove.

12. A linear actuator cylinder designed to reduce stiction, comprising:

an independent cylinder assembly including:

a cylinder barrel having an interior surface defining a hollow interior;

a piston slidably mounted in the hollow interior for movement along a linear axis of the cylinder barrel in response to a longitudinally directed force against the piston;

a single rod extending from an axial end of the piston; and a first cylinder end connected to the cylinder barrel and a second cylinder end connected to the cylinder barrel, the second cylinder end having an opening to slidably receive the single rod therethrough;

a rotator mechanism mounted to the cylinder assembly and including a motor and a drive mechanism that cooperate to impart relative rotation between the piston and the cylinder barrel prior to initiation of the longitudinally directed force;

a fixture rotatably mounted to the rod at an end opposite the piston;

a first attachment bracket connected to the first cylinder end; and a second attachment bracket connected to the fixture, wherein the first and second attachment brackets can be connected and disconnected to selected components.

13. The linear actuator cylinder as recited in claim 12, wherein the motor is mounted to the fixture and the drive mechanism is coupled to the motor and to the rod.

14. The linear actuator cylinder as recited in claim 13, wherein the motor is an electric motor.

15. The linear actuator cylinder as recited in claim 14, further comprising an elastomeric seal connected to the piston limit rotation with respect to the piston.

16. The linear actuator cylinder as recited in claim 15, wherein the motor is a fluid driven motor.

17. A method for reducing stiction in a linear actuator cylinder of the type having a cylinder barrel in which a piston and rod assembly is slidably mounted for reciprocating motion along a linear axis of the cylinder barrel, comprising the steps of:

connecting a rotation mechanism to at least one of the cylinder barrel or the piston and rod assembly;

imparting relative rotational movement between the cylinder barrel and the piston and rod assembly;

placing an elastomeric annular seal between the cylinder barrel and a piston of the piston and rod assembly; and restricting the annular seal from rotation about the piston.

18. The method as recited in claim 17, wherein the step of connecting includes the steps of:

mounting a drive mechanism to a rod of the piston and rod assembly;

attaching a motor to a fixture rotatably mounted to the rod; and driving the drive mechanism with the motor to rotate the piston and rod assembly;

further wherein the step of imparting includes the step of preventing the cylinder barrel from rotating.

19. The method as recited in claim 17, wherein the step of imparting includes the step of imparting continuous relative rotational movement while the piston and rod assembly undergo longitudinal reciprocating motion.

20. The method as recited in claim 17, wherein the step of imparting includes the step of imparting relative rotational movement prior to initiation of movement of the piston and rod assembly along the linear axis.

* * * * *